US005168711A

United States Patent [19]

Moore et al.

[11] Patent Number: 5,168,711

[45] Date of Patent: Dec. 8, 1992

[54] CONVECTIVE HEAT TRANSFER SYSTEM FOR A CRYOGENIC FREEZER

[75] Inventors: Earl W. Moore, Macungie; David J. Klee, Emmaus, both of Pa.

[73] Assignee: Air Products and Chemicals, Inc., Allentown, Pa.

[21] Appl. No.: 712,235

[22] Filed: Jun. 7, 1991

[51] Int. Cl.[5] ..... F25D 13/06

[52] U.S. Cl. ..... 62/63; 62/374; 62/380

[58] Field of Search ..... 62/63, 266, 374, 380

[56] References Cited

U.S. PATENT DOCUMENTS

| | | | |
|---|---|---|---|
| 3,376,710 | 4/1968 | Hirtensteiner | 62/380 |
| 3,403,527 | 10/1968 | Berreth et al. | 62/380 |
| 3,605,434 | 9/1971 | Boese | 62/380 |
| 4,077,226 | 3/1978 | Strong | 62/380 |
| 4,229,947 | 10/1980 | Klee | 62/380 |
| 4,589,264 | 5/1986 | Astrom | 62/380 |
| 4,912,943 | 4/1990 | Hubert et al. | 62/380 |

*Primary Examiner*—Ronald C. Capossela

*Attorney, Agent, or Firm*—James C. Simmons; William F. Marsh

[57] ABSTRACT

Improving the connective heat transfer of a tunnel type cryogenic freezer by positioning the circulating fan blades upside down and closer to the articles moving through the tunnel.

7 Claims, 3 Drawing Sheets

CONVECTIVE HEAT TRANSFER SYSTEM FOR A CRYOGENIC FREEZER

FIELD OF THE INVENTION

The present invention relates to tunnel-type cryogenic food freezers such as shown and described in U.S. Pat. No. 3,892,104, wherein the product (e.g. food) to be refrigerated, and in some cases frozen, moves through an elongated tunnel.

BACKGROUND OF THE INVENTION

One of the more prevalent type of freezers used to provide cryogenic freezing of a product such as a foodstuff is a continuous, in-line tunnel that utilizes liquid nitrogen as an expendable refrigerant. One such apparatus in commercial use is shown in U.S. Pat. Nos. 3,813,895 and 3,892,104, the specifications of both patents being incorporated herein by reference. Freezers of this type sold by Air Products and Chemicals, Inc. under the trademark CRYO-QUICK are continuous, in-line tunnels that utilize liquid nitrogen as the expendable refrigerant. Freezers of this type can achieve high thermal efficiency because they are designed as counterflow heat exchangers. In these freezers liquid nitrogen is sprayed directly onto the food product near the discharge end of the freezer or tunnel. As the liquid nitrogen (LIN) is vaporized, a very cold gas at temperatures of −320° F. (−196° C.) is formed. This cold nitrogen gas is then caused to move through multiple zones of gas recirculation as it flows towards the entrance end of the freezer. Since the maximum available refrigeration of the LIN has been utilized at that point, the warm nitrogen gas can be vented to the atmosphere by an exhaust system.

Liquid nitrogen that is an equilibrium at 35 psia (241 kPa), has a latent heat of 80.5 BTU/lb (187 J/g) when it is vaporized at atmospheric pressure. Gaseous nitrogen has a sensible heat of 79.5 BTU/lb (185 J/g) when it is warmed from −325° F. (−196° C.) to 0° F. (−18° C.). Thus, liquid nitrogen has a total available refrigeration of 160 BTU/lb (372 J/g) under these conditions. Since the sensible heat of the gaseous nitrogen is almost one half of the total available refrigeration, it is necessary to provide effective convective heat transfer to achieve high thermal efficiency in the freezer.

When all other conditions are constant, the forced convection heat transfer coefficient varies as the gas velocity raised to the 0.8 power. As a result, if the gas velocity is doubled, the forced convection heat transfer coefficient will increase by only a factor of 1.74. Further, the volume of gas delivered by a centrifugal fan varies with the fan speed, but the fan power varies with a cube of fan speed. Thus, if the fan speed is doubled to produce greater gas velocity, the fan power will increase by eight times. However, the fan power is an energy input into the freezer and must be minimized to achieve high thermal efficiency. Thus, the most efficient liquid nitrogen food freezer requires a recirculation system that can achieve a high forced convection heat transfer coefficient with the lowest fan energy input.

Another problem with a cryogenic freezer is the presence of frost caused by wet food products, such as raw shrimp, or by a humid operating environment. These circumstances may cause frost to accumulate on the recirculating fans resulting in a significant decrease in the gas velocity at the surface of the food product.

For example, a conventional forward curved centrifugal fan will become clogged with frost in less than one hour, virtually eliminating all gas recirculation. Further, the decreased pressure at the fan inlet will promote the formation of frost, tending to clog the inlet to the recirculating fan.

There are several known solutions to the problem of providing gas recirculation within a cryogenic freezer. One type is an axial fan blade that moves gas in the direction of the axis of fan rotation. Axial fans, sometimes called propeller fans, have several disadvantages in a cryogenic freezer when located above the conveyor belt that moves the product from an inlet end to the exit end of the freezing tunnel, thus directing gas downwardly to the conveyor belt. The gas velocity at the conveyor belt covers a circular area only slightly larger than the fan diameter. Further, the gas velocity is non-uniform across the width of the conveyor belt resulting in non-uniform freezing of the food product. However, the most serious problem with an axial fan blade is the effect of frost formation. Frost will accumulate on and above the fan blade to substantially reduce the gas velocity. Furthermore, the frost deposited on the fan blade will cause vibration problems leading to early mechanical failure of the blades and fan shaft bearings.

U.S. Pat. No. 4,276,753 is typical of a freezer employing the propeller type circulating fans.

The current CRYO-QUICK freezers use a radial type fan with blades that move gas radially outward from the axis of fan rotation. These blades are shown in the '895 patent, most clearly in FIG. 4. As shown in the '895 and '104 patents, as well as the U.S. Pat. No. 4,800,728 and U.S. Pat. No. 4,475,351 the fan blades are positioned just below the inside surface of the roof of the freezing tunnel. The gas recirculation path is radially outward from the blades, down onto the conveyor belt and upward into the fan. The primary benefit of the radial fan blades is its tolerance to frost formation. A significant frost layer, e.g. approximately one-half inch (13 mm) thick does not significantly impair gas recirculation. Furthermore, a frost layer results in fewer vibration problems because the fan blade operates at a lower speed (e.g. 1140 rpm) driven by a shorter fan shaft than an axial fan blade. The radial fan blade provides reasonably uniform gas velocity at the surface of the product being frozen, but has a limitation caused by the recirculation path. Since the gas is lifted upward from the conveyor belt, light products (e.g. food) may be lifted or disturbed by the recirculating fan.

Another type of recirculating fan is shown in U.S. Pat. No. 4,589,264. In the '264 patent the recirculating fans employ a wheel that has four flat paddles placed immediately above the food product. Patentee stresses that the "gas area adjacent the fan wheel is fluctuating and turbulent . . ." Although patentee in FIG. 3 shows gas spiralling downward toward the hub of the fan, the negative pressure at the center of the fan will pull gas equally from above and below the fan wheel. As a result, the area inside the paddles or fan wheels will pull gas upwardly from the conveyor belt and lift or disturb light products being frozen. Furthermore, while patentee indicates that the hub of the fan wheel can be displaced on the shaft in order to raise or lower it, patentees FIG. 3 clearly shows that the shaft of the fan will interfere with the food product if the fan wheel is raised to accommodate a product having greater height.

SUMMARY OF THE INVENTION

It has been discovered that the convective heat transfer of a tunnel type cryogenic freezer can be significantly improved by positioning radial-type recirculating fan upside down and closer to the articles moving through the tunnel for freezing. Utilizing a radial-type fan of the type previously employed in CRYO-QUICK freezers turned upside down and positioned closer to the product being frozen or at a variable height of between 1 and 5 inches from a conveyor belt used to move product to be frozen through the tunnel, will result in at least a 20% increase in the rate of gas-to-solid heat transfer in the zones where the fans are used.

DETAILED DESCRIPTION OF THE INVENTION

Figure 1:
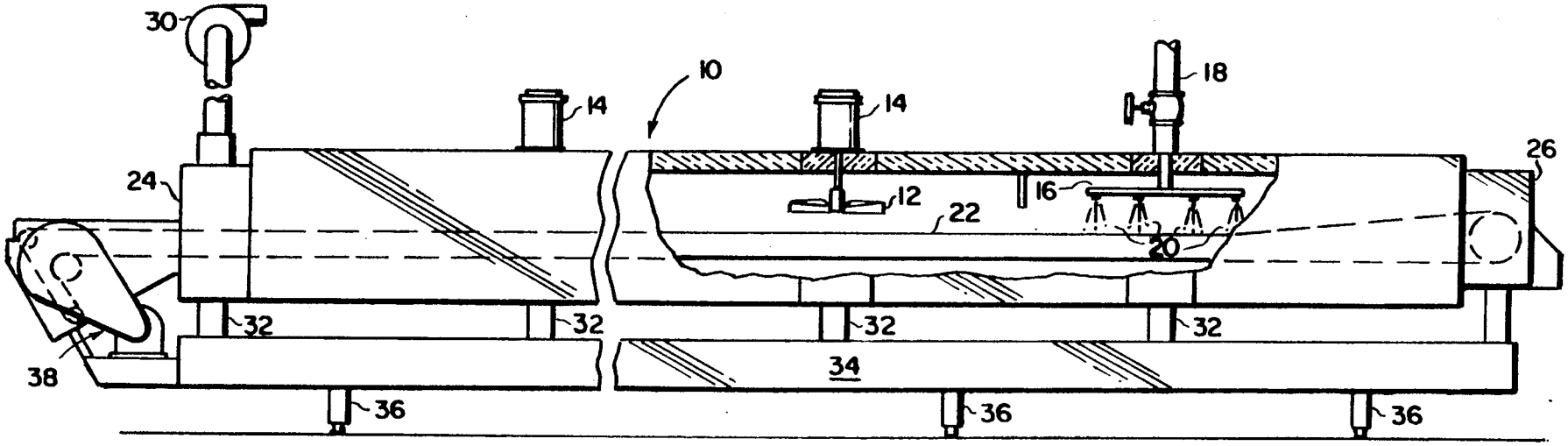
FIG. 1 is a fragmentary elevational view with portions broken away to show the interior details thereof, of freezer according to the present invention.

FIG. 1 shows a cryogenic freezer 10 of the type shown in U.S. Pat. Nos. 3,813,895 or 3,892,104 modified according to the present invention. Freezer or tunnel 10 includes a plurality of recirculating fans 12 and motor assemblies 14 to recirculate vaporized cryogen inside the tunnel. Cryogen is introduced into the tunnel through a spray header 16 connected in turn by a conduit 18 to a supply of liquid cryogen (e.g. liquid nitrogen) not shown. The spray header 16 directs a plurality of nitrogen sprays 20 onto product to be frozen, disposed on an endless conveyor belt 22, positioned to move the articles to be frozen (not shown) from the entry end 24 to the discharge end 26 of the freezer or tunnel 10. At the entry end a blower assembly 30 is used to exhaust warmed cryogen from the tunnel. Freezer 10 includes supports 32, 34, 36 to position the freezer for use. Freezer 10 also includes the necessary assembly 38 to continuously move the conveyor belt 22 through the freezer or tunnel 10.

Figure 2:
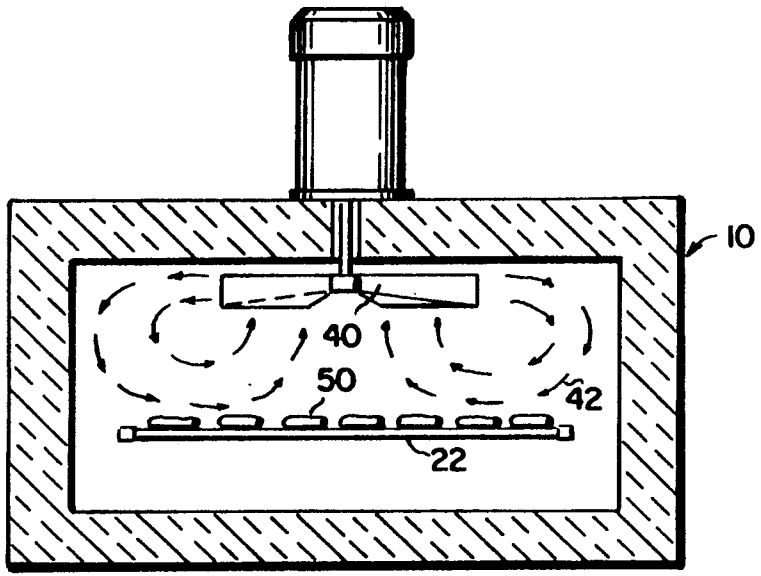
FIG. 2 PRIOR ART
FIG. 2 is a schematic representation of a tunnel showing a recirculating fan positioned according to the prior art.

As shown in FIG. 2, the recirculating fan blade 40 in the tunnel or freezer 10 according to the prior art is mounted so that the blade 40 is adjacent the top or roof of the tunnel. Mounted in this position the gas recirculation path is defined by the arrows 42 so that the vaporized cryogen is directed toward the articles 50 to be frozen that are disposed on the conveyor belt 22.

Figure 3:
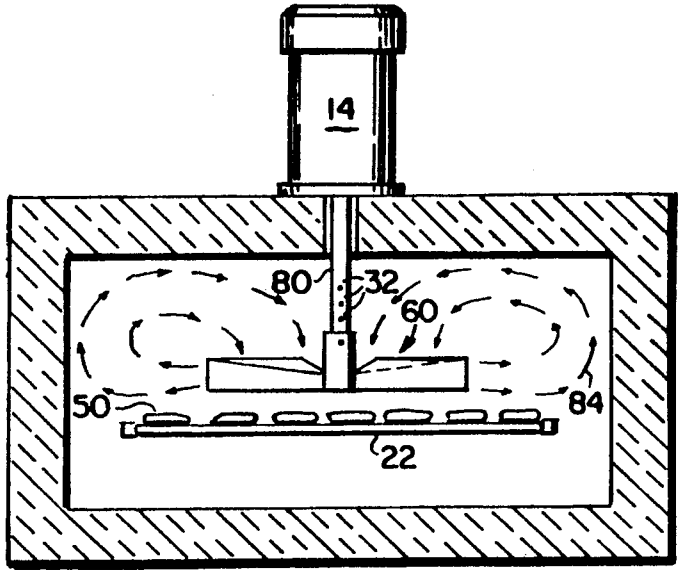
FIG. 3 is an identical cross-sectional view to that shown in FIG. 2 showing a recirculating fan positioned according to the present invention.
Figure 4:
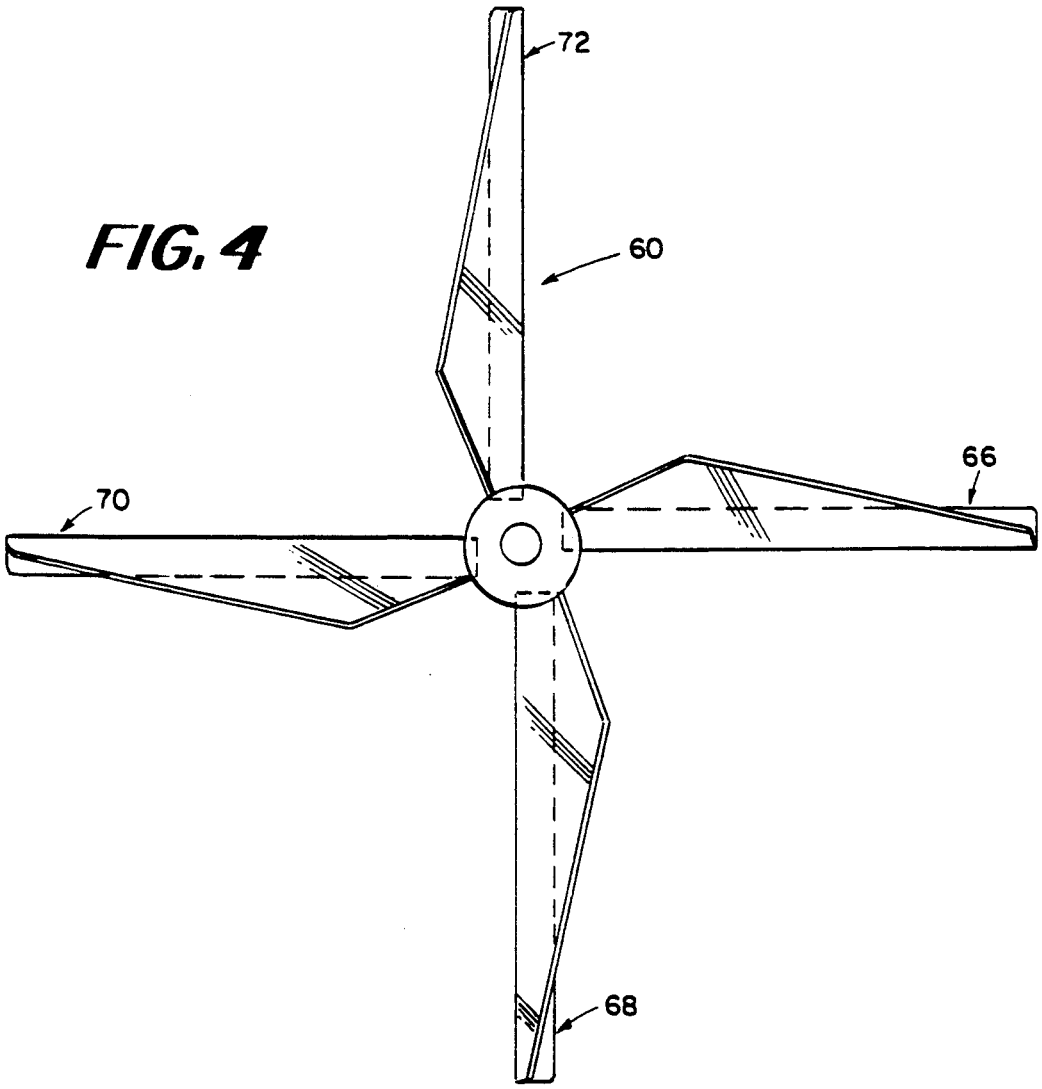
FIG. 4 is a top plan view of the radial type fan blade preferred for the present invention.
Figure 5:
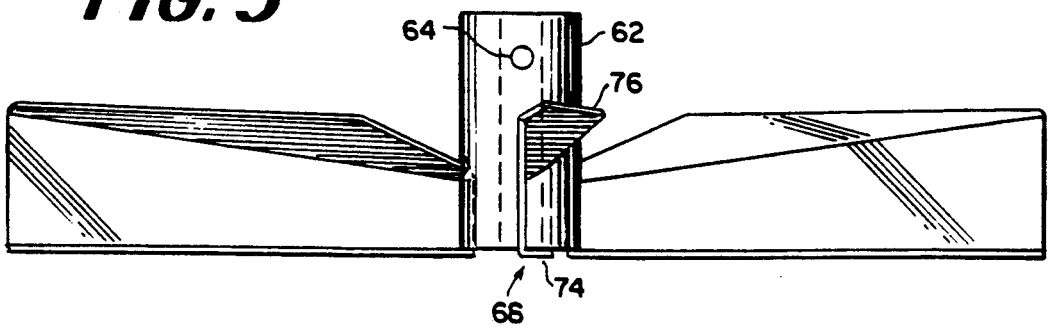
FIG. 5 is a front elevational view of the fan blade of FIG. 4.

According to the present invention the fan blade 60, as shown in FIGS. 4 and 5 and in particular in FIG. 5 is made with an elongated hub 62. The hub is provided with an aperture 64 so that the fan assembly 60 can be mounted in the shaft of a motor such as 14 (FIG. 3) as will be hereinafter more fully described. The radial fan 60 has 4 blades 66, 68, 70, 72 disposed equally about the hub 62. Each of the blades, e.g. 68, has a generally channel shaped cross section. However, the channel has a normal rectangular shaped first or bottom flange 74 and a top or second flange 76. The top flange 76 is in the shape of a five sided polygon having a generally triangular shape and is angled away from the bottom flange 74 as shown in the drawing. Flange 76 is effective to cause a majority of the cryogen to flow downwardly into the blade with minimum flow of cryogen upwardly into the blade to minimize the tendency to lift product off the belt as it moves through the freezer 10. The fan wheel blades of U.S. Pat. No. 4,589,264 result in equal flow of cryogen downwardly and upwardly into the blades thus increasing the tendency to lift product off the belt as it moves through the freezer.

Referring now to FIG. 3, the fan 60 is positioned on the shaft 80 of motor 14 so that the blades are in the upside down position (relative to FIG. 2) and is positioned in close proximity to the articles 50 disposed on belt 22 for refrigeration and/or freezing. Motor shaft 80 is elongated and contains a plurality of mounting holes or apertures 82 so that the position of the blade 60 can be varied to present different heights between the bottom of the blade 60 and the top of the conveyor belt 22. Utilizing the blade 60 in the position shown in FIG. 3, the recirculating path of the vaporizied cryogen is shown by the arrows 84.

In arriving at the arrangement of the present invention, a baffle was first tried to direct recirculating gas parallel to the conveyor belt 22. When the baffle was being assembled for test, it was decided to abandon this idea since the baffle would interfere with cleaning and would make the maintenance of the freezer extremely difficult.

Thereafter, a standard 16" (406 mm) radial fan was tested using the standard "copper patty test".

The copper patty test encompasses utilizing a copper disc or patty approximately 4.03" (102 mm) in diameter and 0.183" (4.65 mm) in thickness having a volume of 2.4 $in^3$ ($3.93\times10^{-5}$ $m^3$) and a surface area of 27.9 $in^2$ (0.018 $m^2$). Thermocouples are attached to the patty as it is sent through the tunnel and the time-temperature profile is measured using a strip chart recorder. At the same time ambient temperature of the gas within the tunnel is also recorded. From the time-temperature profile, the heat transfer coefficient is calculated by assuming Newtonian cooling. This assumption assumes no temperature gradient within the patty and that the heat transfer is controlled strictly by the surface conductance (i.e. there is no internal resistance to heat flow within the patty). The equation used to calculate the heat transfer coefficient h was $$h = \frac{\rho c V}{A}\left[\ln\left(\frac{T_i - T_f}{T - T_{f1}}\right)\right]\frac{1}{t}$$

wherein h=convective heat transfer coefficient $$\frac{\text{BTU}}{\text{hr} - \text{ft}^2 - {}^\circ\text{F.}}\left[\frac{W}{\text{m}^2\ {}^\circ\text{K.}}\right]$$

$\rho$=density of copper, $lb/ft^3$ [$kg/m^3$]

c=specific heat of copper BTU/lb° F. [J/kg° K.]

V=volume of copper disc, $ft^3$ ($m^3$)

A=surface area of copper disc, $ft^2$ ($m^2$)

$T_i$=initial temperature of copper disc, °F. (°K.)

$T_f$=initial temperature of gas, °F. (°K.)

T = final temperature of copper disc, °F. (°K.)
$T_{f1}$ = final temperature of gas, °F. (°K.)
t = time, hr.

A computer program was developed for this equation which was used for the calculations. No other method was used to calculate h.

A series of three copper patty tests using a standard 16" (406 mm) radial fan produced an average heat transfer coefficient of 10.5 BTU/hr-ft$^2$ (59.6 W/m$^2$-K). This test provided the performance data for the recirculating system of a conventional CRYO-QUICK freezer. Thereafter the standard 16" radial fan blade was inverted and positioned 2⅞" (73 mm) above the conveyor belt. The copper patty test produced an average heat transfer coefficient of 14.9 BTU/hr-ft$^2$-F (84.6 W/m$^2$-K). The standard radial fan blade has a formed lip ½" (13 mm) long for mechanical stiffening. Three inches (76 mm) of the formed lip were removed to provide a slight downward direction for the gas flow. A copper patty test for this modification produced a heat transfer coefficient of 14.2 BTU/hr-ft$^2$-°F. (80.6 W/m$^2$-K). Another fan blade assembly was designed with the fan blades tilted 10 degrees down to direct the gas flow downward toward the conveyor belt. A copper patty tests for this fan blade with the tip positioned 3" (76 mm) above the conveyor belt yielded an average heat transfer coefficient of only 13.5 BTU/hr-ft-°F. (76.6 W/m$^2$-K).

A further series of tests were conducted with the inverted fan blade according to the present invention to determine if increased gas velocity would move a standard 1.6 oz. (43.5 g) fresh hamburger patty. A 16" diameter inverted fan moved the hamburger patties when the fan blade was positioned 2⅝" (67 mm) and 3⅝" (92 mm) above the conveyor belt. The fan blade was cut to 14" (356 mm) and positioned 2⅝" (67 mm) above the conveyor belt, but still displaced two of six hamburger patties placed on the conveyor belt. In a final test a 7¼" (184 mm) square plate was attached to the bottom of the 14" (356 mm) inverted fan blade. The square plate was intended to prevent gas from flowing upwardly into the inverted fan blade. None of the hamburger patties moved during this test conducted with the freezer at normal operating temperature. Another prototype fan blade assembly was designed with a 12" (305 mm) diameter flat plate on the bottom for further testing of this concept. A copper patty test with this fan blade positioned 1½" (38 mm) above the conveyor belt produced an average heat transfer coefficient of only 10.3 BTU/hr-ft$^2$-°F. (58.4 W/m$^2$-K). In view of the fact that this is slightly less than the performance of the conventional radial fan blade, this design was then abandoned.

A final series of tests for the inverted fan blade according to the present invention resulted in an average heat transfer coefficient of 19.39 BTU/hr-ft$^2$-°F. (110 W/m$^2$-K) for the inverted fan blade position 2" above the conveyor belt. However, this coefficient was measured along a path 21" (533 mm) long centered about the axis of fan rotation. When the temperature data is evaluated for the full 60" (1.5 m) length of the recirculating zone, the average heat transfer coefficient is 15.0 BTU/hr-ft$^2$-°F. (85.2 W/m$^2$-K). The test conducted included measuring by liquid nitrogen calorimetry the amount of heat removed from ¼ lb. (113 g) fresh hamburger patties. The two inverted fans in a test freezer increased the heat removal to 66.9 BTU/lb (156 J/g) compared with 59.2 BTU/lb (138 J/g) for a conventional CRYO-QUICK recirculation system, an increase of 13.0%. Since the inverted fan affected only 10 ft (3.0 m) of the freezer length of 21 ft (19.5 m), the improved recirculation system increased the gas-to-solid heat transfer by 27.4% in those zones. Therefore, it is reasonable to assume that at least a 20% increase in heat transfer will be affected in the freezing tunnel.

As set out above, when the radial type fan according to the present invention as shown in FIGS. 4 and 5 is made with a lengthened hub and the radial fan is assembled to the fan motor, the fan can be positioned with the hub pointing downward to produce a recirculating gas arrangement similar to that in the CRYO-QUICK freezer. When the radial-type fan is inverted with the hub pointing upward, the result is the inverted fan position. In this configuration, the bottom edge of the fan blades can be positioned 1½, 2½, 3½ or 4½" (38, 64, 89, or 114 mm) above the conveyor belt by selecting the appropriate hole in the fan motor shaft. For most food products, the fan blade height is selected to provide about 1" (25 mm) of clearance between the top of the food product and the bottom of the fan blade.

The improved recirculation system of the present invention provides more convective heat transfer in a cryogenic freezer because it places the high velocity gas in close proximity to the product being cooled. The improved system does not achieve higher convective heat transfer by increasing the volume or the velocity of the recirculating gas. Thus, the fan energy input into the freezing system does not increase. Furthermore, the radial fan configuration is retained with its tolerance to frost formation encountered with food freezing systems.

Another feature of the invention is the shape of the fan blade that minimizes lifting gas (and food products) upward from the conveyor belt. If light food products are displaced by the recirculating gas, the inverted fan blade can be easily positioned at a greater height about the food product. Finally, inverted fan blade can be turned upside down to achieve the same recirculating characteristics as a conventional CRYO-QUICK freezer.

Furthermore, since the lifting force on a light product, e.g. food, is linear with gas density, the height above the conveyor belt should be increased for a lower operating temperature. Thus, for a standard CRYO-QUICK freezer, the optimum height will gradually increase from a relatively warm entrance zone of the freezer to the much colder zone adjacent the liquid nitrogen spray section. The fan blade in each recirculation zone will be fixed at a different height above the conveyor belt to assure maximum convective heat transfer.

Having thus described our invention, what is desired to be secured by Letters Patent of the United States is set forth in the appended claims.

We claim:

1. A method for improving the connective heat transfer in a cryogenic freezer of the type having an elongated tunnel with an entry end and a discharge end, means to move items to be frozen from such entry exit to said exit end, means to spray a liquid cryogen on said items in said tunnel and a plurality of vaporized cryogen recirculating fans disposed inside said tunnel comprising:

inverting said recirculating fans having means to direct a majority of the cryogen flow downwardly into the fans and positioning said fans at a distance of from 1½ inches to 4½ inches above said items moving through said tunnel.

2. A method according to claim 1 wherein said fans have radial type fan blades.

3. A method according to claim 1 wherein said means to move said items in an endless conveyor belt and said fan blades being of the radical type are positioned from 1½ inches to 4¼ inches above said belt.

4. A method according to claim 1 wherein the gas-to-solid heat transfer in each zone of said freezer having a recirculating fan is increased by at least 20% when said fans have a radical type fan blade.

5. A method according to claim 1 wherein the fan is positioned to provide about one inch of clearance between the fan blades and the item moving through the freezer.

6. A cryogenic freezer comprising in combination: an elongated tunnel with an entry end and a discharge end, means to move items to be frozen from said entry and to said exit end, means to spray liquid cryogen on said items in said tunnel said spray means located proximate said discharge end of said tunnel and a plurality of recirculating fans disposed between said entry end and said spray means, each of said fans being of the radial type with four blades disposed around a central bulb, each of said blades having a generally channel shaped cross-section with each channel section having a rectangular shaped bottom flange and a top flange in the shape of a five-sided polygon having a generally triangular shape angled away from the bottom flange, individual motors having an elongated shaft to position each of said fans with the bottoms of the blades positioned juxtaposed to said means to move items to be frozen, said shafts adapted to position each fan at different locations along the length of the shaft said fans positioned with approximately one inch clearance between said bottom of said blades of said fan and the items moving though said tunnel whereby convective heat transfer in said freezer is improved.

7. A freezer according to claim 6 wherein said means to move said items includes an endless conveyor belt and said fan blades are variably positionable a distance of from 1½ to 4½ inches from said belt.

* * * * *